US012303014B2

(12) United States Patent
Dishon

(10) Patent No.: US 12,303,014 B2
(45) Date of Patent: May 20, 2025

(54) LIGHTED TOOTHBRUSH

(71) Applicant: Ranir, LLC, Grand Rapids, MI (US)

(72) Inventor: Bryan J. Dishon, Alto, MI (US)

(73) Assignee: Ranir, LLC, Grand Rapids, MI (US)

( * ) Notice: Subject to any disclaimer, the term of this patent is extended or adjusted under 35 U.S.C. 154(b) by 45 days.

(21) Appl. No.: 18/093,890

(22) Filed: Jan. 6, 2023

(65) Prior Publication Data

US 2024/0225256 A1 Jul. 11, 2024

(51) Int. Cl.
*A46B 15/00* (2006.01)

(52) U.S. Cl.
CPC ..... *A46B 15/0036* (2013.01); *A46B 15/0008* (2013.01); *A46B 2200/1066* (2013.01)

(58) Field of Classification Search
None
See application file for complete search history.

(56) References Cited

U.S. PATENT DOCUMENTS

| | | | |
|---|---|---|---|
| 8,176,591 | B2 | 5/2012 | Iwahori et al. |
| 8,429,783 | B2 | 4/2013 | Russell et al. |
| 8,681,008 | B2 | 3/2014 | Jimenez et al. |
| 8,758,022 | B2 | 6/2014 | Kim |
| 8,789,227 | B2 | 7/2014 | Cook et al. |
| 8,832,895 | B2 | 9/2014 | Jungnickel et al. |
| 9,027,192 | B1 | 5/2015 | Cole |
| 9,038,226 | B1 | 5/2015 | Franklin |
| 9,144,476 | B2 | 9/2015 | Iwahori et al. |
| 9,271,566 | B1 | 3/2016 | Belge-Barnes |
| 9,457,199 | B2 | 10/2016 | Lin |
| 9,462,878 | B1 | 10/2016 | Filo et al. |
| 9,498,053 | B2 | 11/2016 | Patel |
| 9,521,899 | B1 | 12/2016 | Tai |
| 9,565,927 | B2 | 2/2017 | Bloch et al. |
| 9,681,744 | B2 | 6/2017 | Russell et al. |
| 9,731,882 | B2 | 8/2017 | Lee et al. |
| 9,848,968 | B2 | 12/2017 | Jungnickel et al. |
| 10,086,262 | B1 | 10/2018 | Capper et al. |
| 10,098,586 | B2 | 10/2018 | Kusukame et al. |
| 10,188,203 | B2 | 1/2019 | Van Gool et al. |
| 10,271,934 | B2 | 4/2019 | Huy et al. |
| 10,298,471 | B2 | 5/2019 | Bauer et al. |

(Continued)

*Primary Examiner* — Brian D Keller
*Assistant Examiner* — Jason Khalil Hawkins
(74) *Attorney, Agent, or Firm* — Warner Norcross + Judd LLP

(57) ABSTRACT

A lighted toothbrush includes a handle housing with toothbrush components mounted within the internal cavity, including a power source, a printed circuit board, and a plurality of light emitting diodes (LEDs). The LEDs are mounted to the printed circuit board at generally the same position along the longitudinal length of the circuit board, with a first one of the LEDs mounted to the first surface of the printed circuit board, and a second one of the LEDs mounted to the second surface of the printed circuit board. A light ring formed of a light transmissive material is positioned on the handle housing adjacent the first and second ones of the plurality of LEDs, wherein light from the first LED is visible through the light ring at a first circumferential position on the handle housing and light from the second LED is visible through the light ring at a second circumferential position on the handle housing.

20 Claims, 8 Drawing Sheets

(56) References Cited

U.S. PATENT DOCUMENTS

| | | | |
|---|---|---|---|
| 10,349,733 | B2 | 7/2019 | Serval et al. |
| 10,463,463 | B2 | 11/2019 | Luo et al. |
| 10,543,069 | B2 | 1/2020 | Tamminga et al. |
| 10,610,008 | B2 | 4/2020 | Wagner et al. |
| 10,646,314 | B2 | 5/2020 | Zhou |
| 10,674,810 | B2 | 6/2020 | Bloch |
| 10,702,055 | B2 | 7/2020 | Xi et al. |
| 10,702,056 | B2 | 7/2020 | Xi et al. |
| 10,743,650 | B2 | 8/2020 | Katano et al. |
| 10,772,713 | B2 | 9/2020 | Sohn |
| 10,813,731 | B2 | 10/2020 | Shreve |
| 10,825,355 | B2 | 11/2020 | Varga et al. |
| 10,835,028 | B2 | 11/2020 | Gatzemeyer et al. |
| 10,842,254 | B2 | 11/2020 | Tamminga et al. |
| 10,874,493 | B2 | 12/2020 | Vetter et al. |
| 10,874,494 | B2 | 12/2020 | Zhou |
| 10,925,387 | B2 | 2/2021 | Nishiura et al. |
| 10,932,554 | B2 | 3/2021 | Greer, Jr. et al. |
| 10,966,516 | B2 | 4/2021 | Hohlbein et al. |
| 10,980,410 | B1 | 4/2021 | Hu et al. |
| 10,993,524 | B2 | 5/2021 | Buil et al. |
| 11,000,118 | B2 | 5/2021 | Rivera et al. |
| 11,006,742 | B2 | 5/2021 | Jeanne et al. |
| 11,051,609 | B2 | 7/2021 | Boere et al. |
| 11,051,659 | B2 | 7/2021 | LaRocca |
| 11,076,938 | B2 | 8/2021 | Zhou |
| 11,141,252 | B2 | 10/2021 | Okai et al. |
| 11,173,018 | B1 | 11/2021 | O'Beimne |
| 11,197,537 | B2 | 12/2021 | Hardeman et al. |
| 11,202,499 | B2 | 12/2021 | Vugts et al. |
| 2003/0205492 | A1 | 11/2003 | Ferber et al. |
| 2011/0247158 | A1 | 10/2011 | Jungnickel |
| 2015/0013088 | A1 | 1/2015 | Li |
| 2018/0168332 | A1* | 6/2018 | Wagner ..... A61C 1/088 |
| 2019/0069978 | A1* | 3/2019 | Katano ..... A61C 17/3481 |
| 2020/0205561 | A1 | 7/2020 | Wagner et al. |
| 2020/0329858 | A1 | 10/2020 | Katano et al. |
| 2021/0145539 | A1* | 5/2021 | Greve ..... A61H 37/00 |
| 2021/0177558 | A1 | 6/2021 | Payne et al. |
| 2021/0204685 | A1 | 7/2021 | Christensen et al. |
| 2021/0315369 | A1 | 10/2021 | Jungnickel |

* cited by examiner

LIGHTED TOOTHBRUSH

BACKGROUND OF THE INVENTION

The present invention relates to toothbrushes, and more particularly to a toothbrush with LEDs, and a structure for mounting the LEDs and positioning the toothbrush components in a manner that can be efficient to assemble and effective at encouraging brushing.

To ensure proper oral care, dentists recommend that we brush our teeth more than once a day for at least two to three minutes each time. Despite this recommendation, the average adult person does not brush his or her teeth for two to three minutes. This problem is worse with children, who have notoriously short attention spans and often view brushing their teeth as a chore. Accordingly, there continues to be a need for a device that improves upon past efforts to encourages people, especially children, to brush their teeth more often and for longer periods of time.

SUMMARY OF THE INVENTION

The present invention provides a toothbrush with a structure and assembly that enables creative and interactive lighting and light sequencing for a variety of applications, such as game-like sequencing for children.

In one embodiment, the lighted toothbrush includes a handle housing having a first end and a second end, the first end including an attachment structure for selective attachment to a toothbrush head. The handle housing defines an interior cavity, and various toothbrush components are mounted within the internal cavity, including a power source, a printed circuit board, and a plurality of light emitting diodes (LEDs).

In one embodiment, the printed circuit board includes a first surface, a second surface opposite the first surface, a left side edge, and a right side edge. A plurality of the LEDs are mounted to the printed circuit board at generally the same position along the longitudinal length of the circuit board, with a first one of the LEDs mounted to the first surface of the printed circuit board, and a second one of the LEDs mounted to the second surface of the printed circuit board. A power switch is mounted on the printed circuit board in electrical communication with the power source and with the plurality of LEDs, wherein the power switch can be pressed by a user to activate one or more of the plurality of LEDs.

A light ring formed of a light transmissive material is positioned on the handle housing adjacent the first and second ones of the plurality of LEDs, wherein light from the first LED is visible through the light ring at a first circumferential position on the handle housing and light from the second LED is visible through the light ring at a second circumferential position on the handle housing. The light ring may include an exterior circumference and an interior circumference, the interior circumference defining an interior light space, wherein a portion of the printed circuit board including the first and second indicator LEDs is positioned in the interior light space. For example, one longitudinal end of the printed circuit board may be inserted into the interior light space formed by the light ring, such that the first LED and the second LED are aligned with and visible through the light ring when the LEDs are activated.

The plurality of LEDs may include more than two LEDs, such as one embodiment that includes four LEDs, with a third LED mounted to the first surface of the printed circuit board and directing light outwardly from the left side edge of the circuit board, and a fourth LED mounted to the second surface of the printed circuit board and directing light outwardly from the right side edge of the circuit board. The LEDs may be evenly spaced about the circuit board. In one embodiment, the plurality of LEDs also includes a power LED, which is mounted to the printed circuit board and spaced from the indicator LEDs along the longitudinal length of the printed circuit board.

In another embodiment the power switch is mounted on one of the first and second surfaces of the printed circuit board, and the power switch includes a projection that can be depressed by a user to activate the power switch. The projection may extend beyond one of the left and right side edges of the printed circuit board. The handle housing may define an opening adjacent to the one of the left and right side edges of the circuit board, and a power button may be positioned within the opening such that a user can press the power button to engage and depress the power switch. In one embodiment, a power button LED is positioned on the printed circuit board, and positioned such that the power button LED is visible through the power button when the button LED is activated. In one embodiment, the lighted toothbrush includes a microcontroller that is programmed to sequentially light the plurality of LEDs for a predetermined application, such a game sequence.

Figure 1:
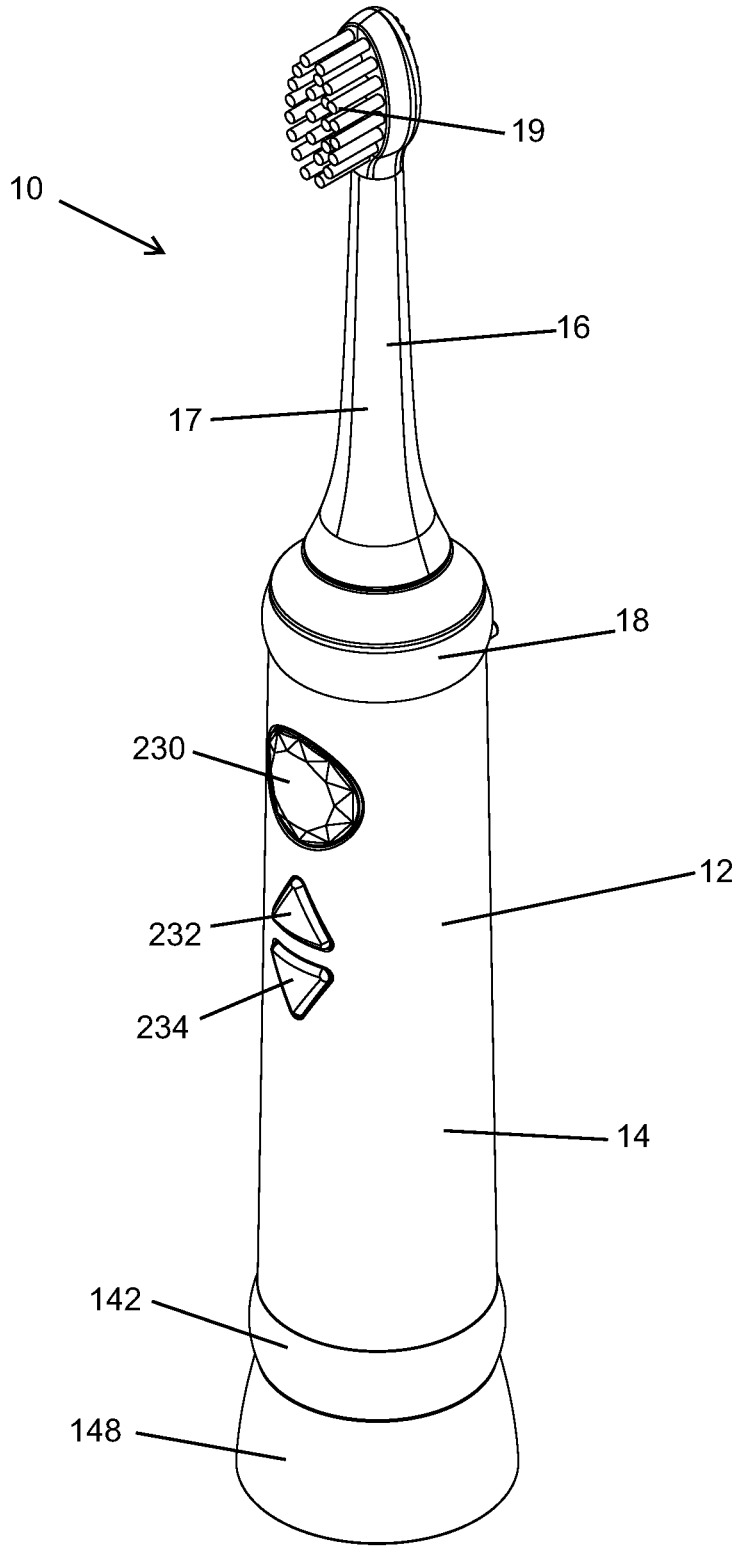
FIG. 1 is a perspective view of a lighted toothbrush according to one embodiment of the present invention.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 2:
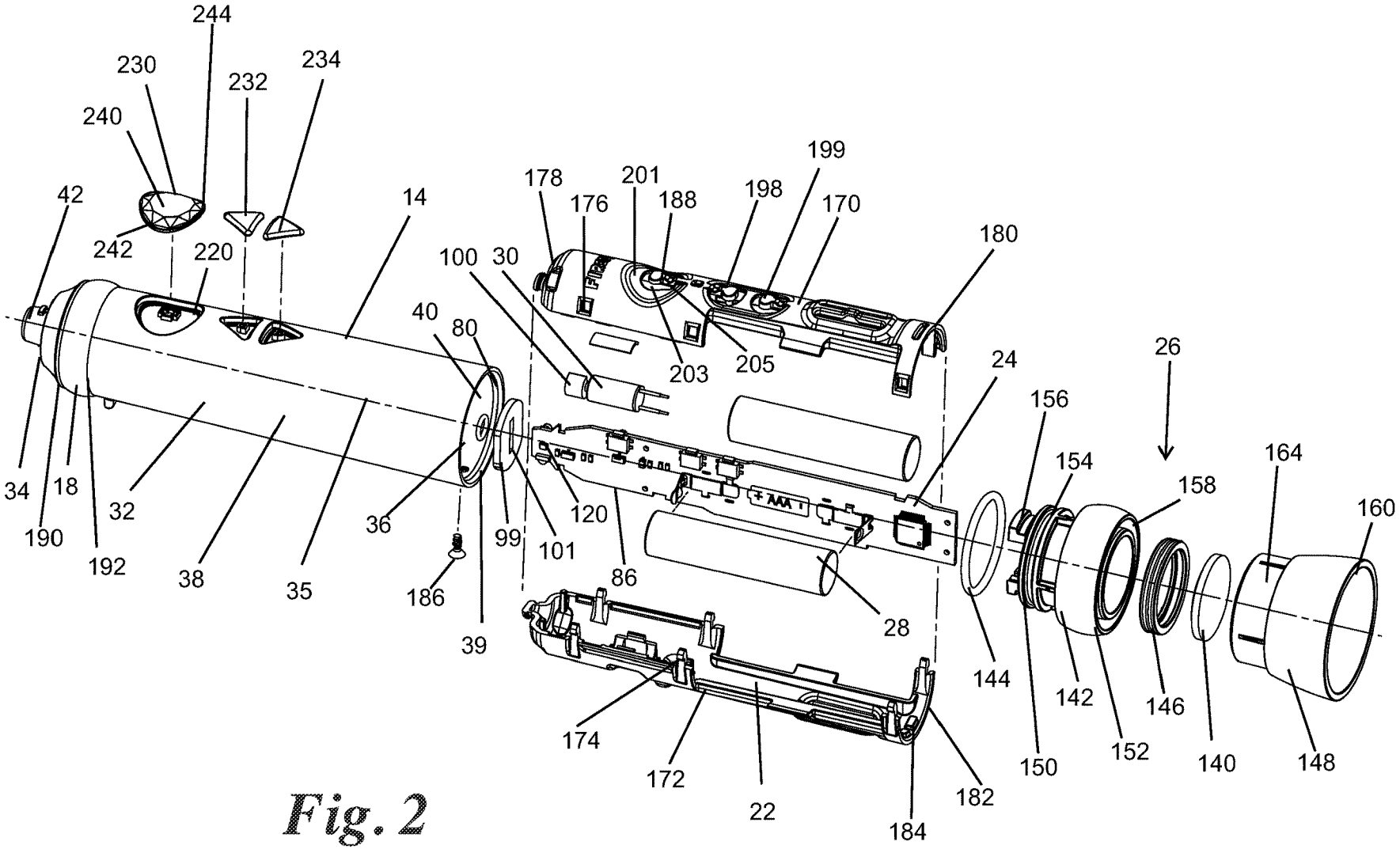
FIG. 2 is an exploded view of a lighted toothbrush handle according to the one embodiment.

The embodiments of the invention described herein relate to a toothbrush 10, including a lighted handle 12. In one embodiment, the handle 12 includes a handle housing 14 for supporting a brush head 16 having a neck 17 and a plurality of cleaning elements 19. As described herein, the handle housing 14 includes a light ring 18 through which light from a series of LEDs 20 is visible and can be displayed in a desired sequence. Referring to FIG. 2, the handle 12 generally includes the handle housing 14, an inner housing 22, a printed circuit board 24, a speaker assembly 26, a power source such as one or more batteries 28, and a motor 30.

The handle housing 14 includes a housing sidewall 32 having a first end 34 and a second end 36 defining a longitudinal length therebetween extending along longitudinal axis 35. In the illustrated embodiment, the sidewall 32 is generally cylindrical, and includes an exterior surface 38, and an interior surface 39 that defines an interior cavity 40. In an alternative embodiment, the handle housing 14 may have a different cross sectional shape, such as oval or square, and may have a cross section that is non-uniform along the longitudinal length.

Figures 5, 6, 7, 8:
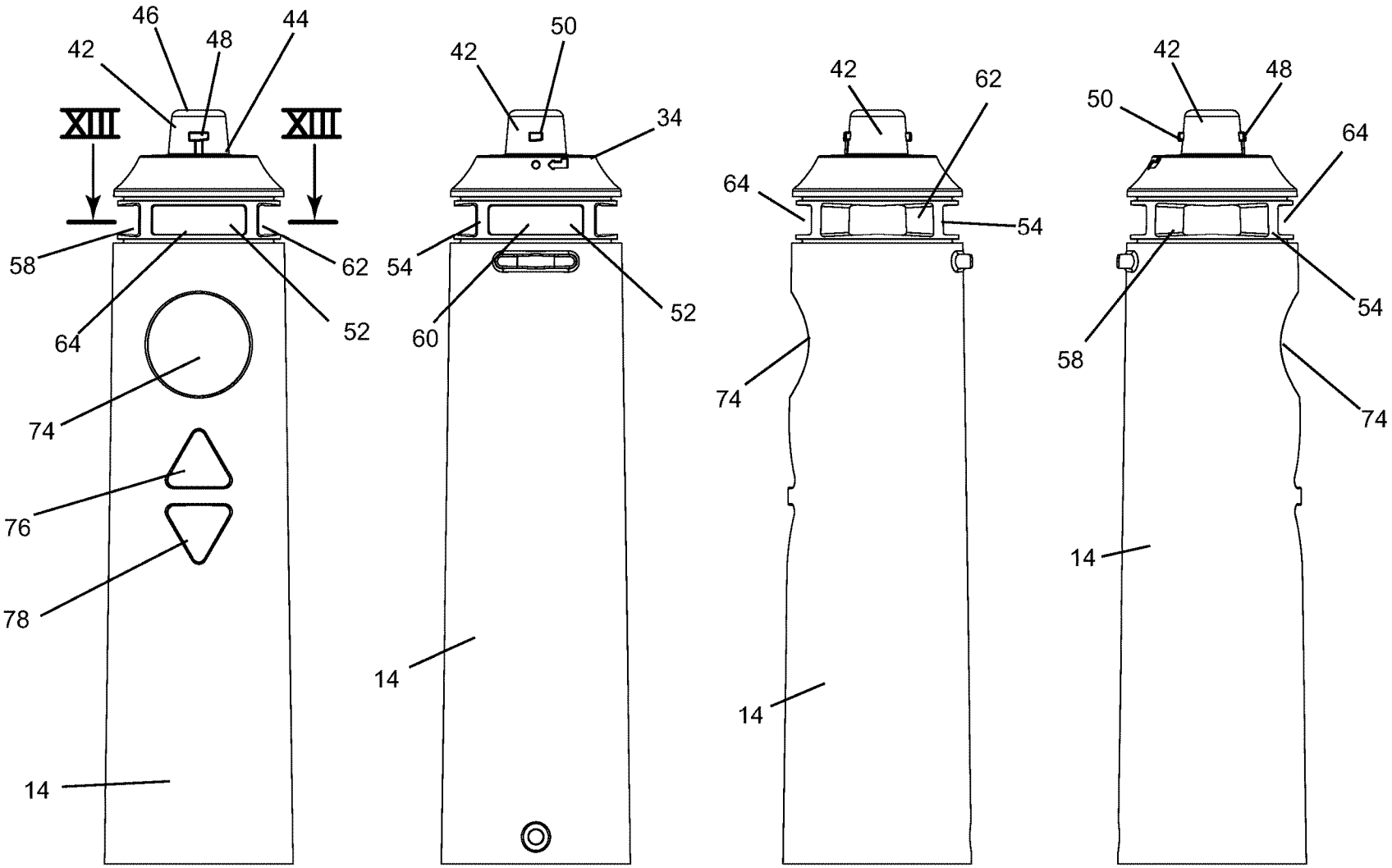
FIG. 5 is a front view of a handle housing according to one embodiment.
FIG. 6 is a rear view thereof.
FIG. 7 is a right side view thereof.
FIG. 8 is a left side view thereof.

An attachment structure for attachment to the brush head 16 may extend from the first end 34 of the handle housing 14. As illustrated, this structure includes a generally frustoconical protrusion 42 extending outwardly from the first end 34 of the handle housing 14. Referring to FIGS. 5 and 6, the protrusion 42 includes a base 44 and a distal end 46, and a cross section that narrows from the base 44 to the distal end 46. In one embodiment, the protrusion 42 includes first 48 and second 50 tabs that enable attachment of the brush head 16 to the protrusion 42 in a bayonet-style. The outwardly protruding tab 48 extends a lateral direction across the protrusion, and the outwardly protruding tab 50 extends in a lateral direction on an opposite side of the protrusion 42. In this embodiment, the protrusion 42 can be inserted into the neck 17 of the brush head 16 and rotated to hold the brush head on the handle 14. Other known attachment methods, including a friction fit, can otherwise be used.

Figure 13:
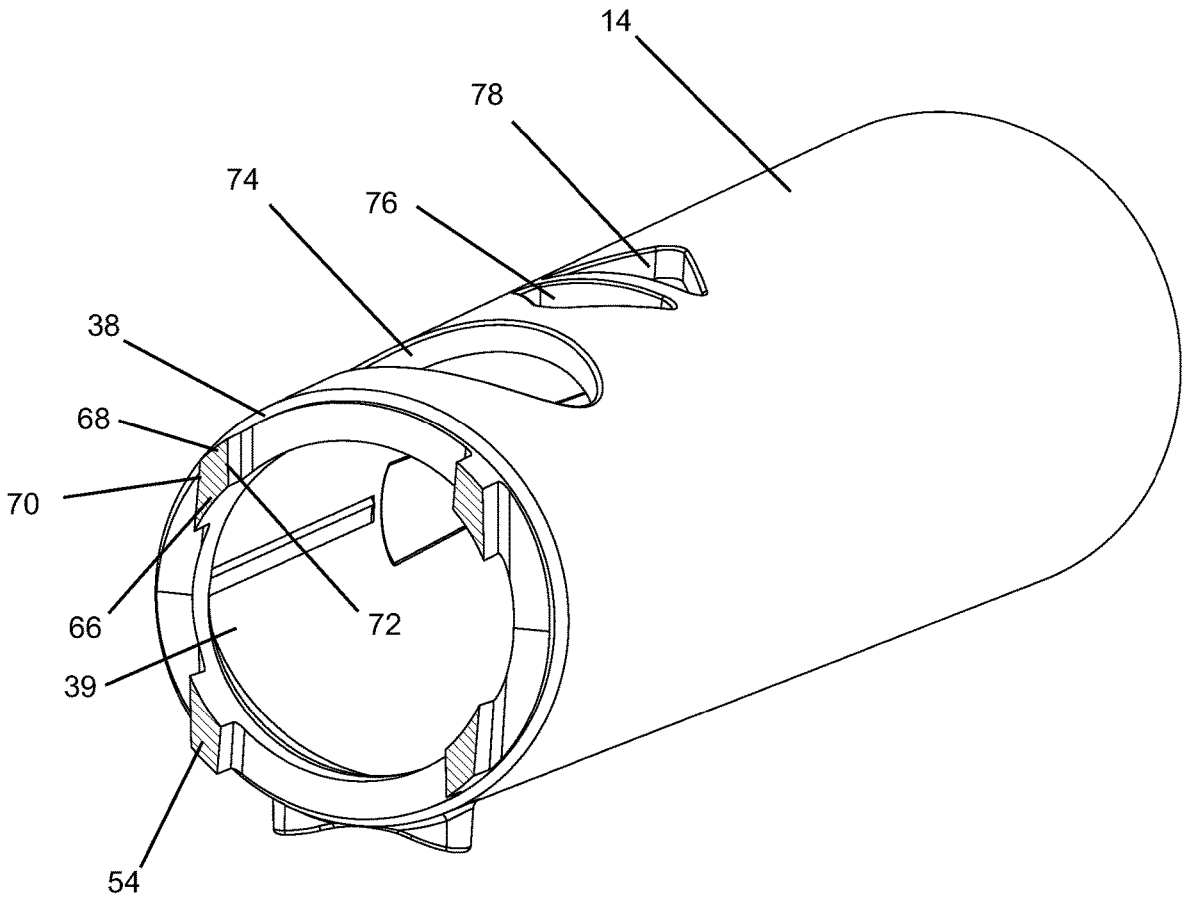
FIG. 13 is a sectional view of the handle housing taken along line XIII-XIII in FIG. 5.

In one embodiment, the handle housing 14 defines an opening 52 for attachment of the light ring 18. As illustrated, this opening 52 is a circumferential opening that is positioned proximate to the first end 34 of the handle housing 14. The opening 52 is spanned longitudinally by four struts 54, and as shown the struts 54 are evenly spaced about the circumference of the handle housing 14 to divide the opening 52 into four circumferential light ring openings 58, 60, 62 and 64. Referring to FIG. 13, in one embodiment, each strut 54 extends from an interior edge 66 at the interior surface 39 of the handle housing 14 to an exterior edge 68 at the exterior surface 38 of the handle housing 14, with the interior 66 and exterior 68 edges forming a strut thickness therebetween. Each strut 54 includes an first lateral edge 70 and an second lateral edge 72 extending between the interior 66 and exterior 68 edges, forming a strut width therebetween. In the illustrated embodiment, the strut lateral edges 70, 72 are generally parallel to each other and to the lateral edges 70, 72 of the other struts, and the strut thickness is greater than the strut width. As a result, the opposing light ring openings 58, 62 are larger than the light ring openings 60, 64. In other embodiments the struts may have different thicknesses and orientations to size the various light ring openings as desired. In another embodiment, the handle housing 14 may have a different number of struts to form a different number of light ring openings.

Referring again to FIG. 5, the handle housing 14 may define one or more openings for switches that can operate one or more functions of an electric toothbrush. As shown, the handle housing defines a power button opening 74, and a pair of operation openings 76, 78. Although such openings may have a variety of sizes and shapes, in the illustrated embodiment, the power button opening 74 is generally round or oval in shape, and the operation openings 76, 78 are generally triangular and aligned with the power button opening 74 along the longitudinal length of the handle housing 14. The handle housing 14 as shown has a cavity opening 80 at the second end 36 providing access to the interior cavity 40. In one embodiment, the fully assembled interior components, such as the inner housing 22, printed circuit board 24, power source 28, and motor 30 can be connected to the speaker assembly 26 and inserted into the cavity opening 80 as noted in more detail below.

Figure 3:
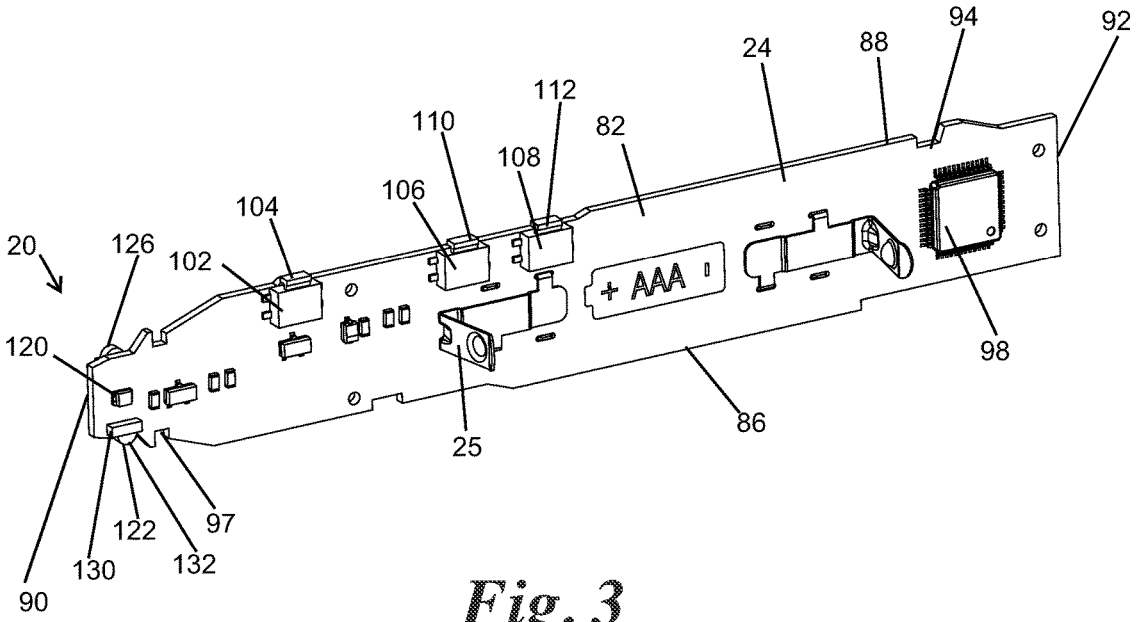
FIG. 3 is a front perspective view of a printed circuit board according to one embodiment.
Figure 4:
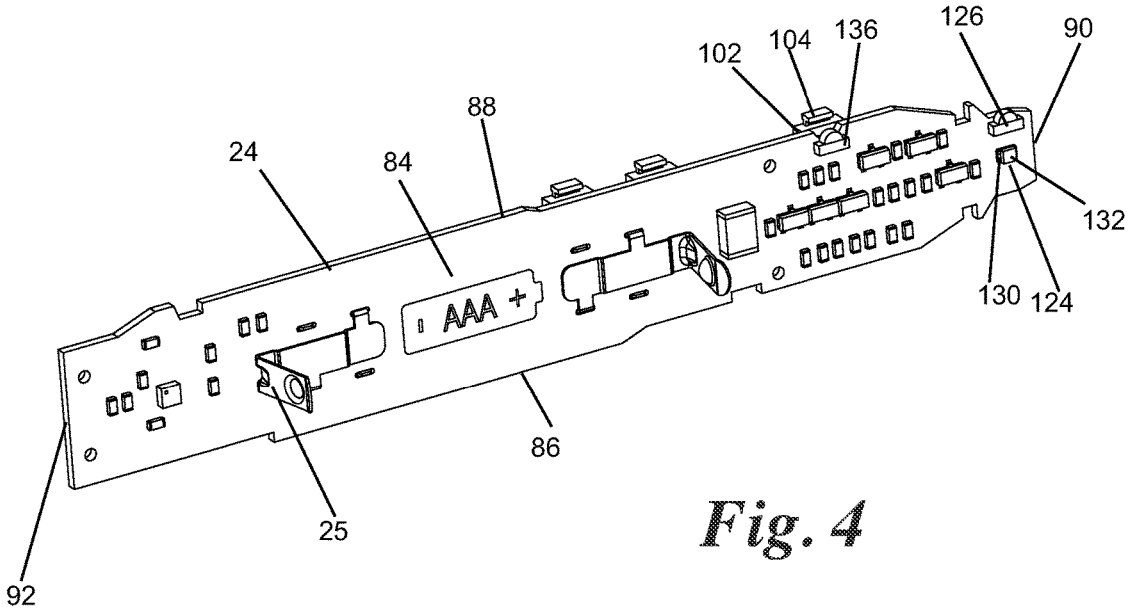
FIG. 4 is a rear perspective view of the printed circuit board.

The printed circuit board 24 is positioned within the interior cavity 40. Referring to FIGS. 3 and 4, in one embodiment, the printed circuit board 24 has a generally flat first surface 82, and a generally flat second surface 84 opposite the first surface 82. The circuit board 24 includes a left side edge 86 and a right side edge 88, and opposing longitudinal ends 90, 92 forming a longitudinal length therebetween. The printed circuit board 24 creates an electrical connection between various components mounted to the circuit board 24. In one embodiment, the width of the printed circuit board 24 between the left 86 and right 88 side edges is uniform for substantially the entire longitudinal length of the printed circuit board 24, but in the illustrated embodiment, the width tapers near the first longitudinal end 90. The printed circuit board 24 may include a notch 94 in the side edges 86, 88, and may include additional notches for locating and attaching the printed circuit board 24 within the inner housing 22. As shown, the printed circuit board 24 includes a pair of opposing notches 97 near the first longitudinal end 90 for interfitting with a spacing ring 99 that may define a slot 101 that can snap fit onto the printed circuit board 24 and fit tightly within the inner housing 22 to reduce movement of the printed circuit board 24 in the inner housing 22.

The power source 28 may be mounted to the printed circuit board 24. As shown in FIG. 2, the power source 28 includes a pair of batteries 28 mounted to opposite surfaces 82, 84 of the printed circuit board 24 in electrical connection to the circuit board 24 between pairs of electrical contacts 25. A microcontroller 98 is also mounted to the printed circuit board 24 and electrically connected to the printed circuit board 24. The microcontroller may be programmed to operate the various components on the circuit board 24 to meet the desired application. With reference to FIG. 2, a motor 30 may be mounted to the printed circuit board 24. Various types of motors are known for use in electric toothbrushes, including for driving a drive shaft that can move the brush head 16 in a desired pattern. In the illustrated embodiment, the motor 30 includes an eccentric weight 100 mounted to the drive shaft of the motor 30, such that activation of the motor 30 will rotate the eccentric to provide a degree of vibration to the handle 12 and brush head 16.

A power switch 102 is mounted to the circuit board 24 for enabling a user to activate one or more of the electrical components mounted to the circuit board 24. In one embodiment, the power switch 102 includes a projection 104 that extends from the power switch 102 can be depressed by a user to activate the power switch 102 and energize the components on the circuit board. As shown, the power switch 102 is mounted to the first surface 82 of the printed circuit board 24 adjacent to the right side edge 88 of the printed circuit board 24 with the projection 104 extending beyond the right side edge 88 in a direction perpendicular to the longitudinal axis 35. In one embodiment, two operation switches 106, 108 are also mounted to the printed circuit board 24. The operation switches 106, 108 include projections 110, 112 respectively that can be depressed to activate the switches 106, 108. In the illustrated embodiment, the operation switches are—similar to the power switch 102—mounted to the first surface 82 of the printed circuit board 24 adjacent to the right side edge 88 of the printed circuit board 24 with the projections 110, 112 extending beyond the right side edge 88 in a direction perpendicular to the longitudinal axis 35. The operation switches are spaced from the power switch 102 along the longitudinal length of the printed circuit board 24.

As noted, a plurality of light emitting diodes (LEDs) are also mounted to the printed circuit board 24. The plurality of LEDs includes a series of indicator LEDs 20 that are electrically connected to the printed circuit board 24 such that they can be operated by the power switch 102 and operation switches 106, 108, and controlled by the program of the microcontroller. In the illustrated embodiment, there are four indicator LEDs 20 mounted to the printed circuit board 24. The indicator LEDs as shown are all located at the same position along the longitudinal length of the printed circuit board 24, but are spaced apart from each other on the first 82 and second 84 opposite surfaces and directionally disposed on the printed circuit board 24 to project light in four distinct directions. Referring, for example, to FIGS. 3 and 4, the indicator LEDs 20 include a first indicator LED 120 mounted to the first surface 82 and generally at a midpoint between the left 86 and right 88 side edges with the LED 120 directed away from the first surface 82, a second indicator LED 122 mounted to the first surface 82 and positioned at the left side edge 86 with the LED 122 directed away from the left side edge 86, a third indicator LED 124 mounted to the second surface 84 and generally at a midpoint between the left 86 and right 88 side edges with the LED 124 directed away from the second surface 84 (in a direction generally opposite the direction of the first indicator LED 120), and a fourth indicator LED 126 mounted to the second surface 84 and positioned at the right side edge 88 with the LED 126 directed away from the right side edge 88 (in a direction generally opposite the direction of the second indicator LED 122). Although the indicator LEDs can be positioned at any location along the longitudinal length of the printed circuit board 24, in the illustrated embodiment they are positioned proximate the first longitudinal end 90 and between the spacing ring 99 and the first end 90. Notably, each of the LEDs 20 may include a base 130 and a lens 132, and the direction of the LEDs 20 may be determined by the positioning of the lens 132 with respect to the base 130 as the LED is mounted to the printed circuit board 24. For example, with reference to FIG. 3, the light from the first indicator LED is directed away from the first surface 82 of the printed circuit board 24 as a result of the base 130 being positioned between the first surface 82 and the lens 132. In contrast, the light from the second indicator LED 122 is directed away from the left side edge 86 as a result of its lens 132 being positioned to the left of its base 130.

In addition to the indicator LEDs, at least one power button LED 136 may be mounted to the circuit board 24. As shown in FIG. 4, the power button LED 136 is mounted to the second surface 84 of the printed circuit board 24 adjacent to the right side edge 88 and directly opposite the power switch 102. In one embodiment, the light of the power button LED is directed away from the right side edge 88, such that the direction of the light is generally parallel to the direction of the movement of the projection 104 of the power switch 102. The power button LED 136, and any other of the LEDs 20, may be a multi-colored LED that can be programmed to be lit with a desired one of the multiple color options. In one embodiment, the LED's may be positioned or spaced differently on the printed circuit board 24, and the handle 12 may be provided with fewer or a greater number of indicator LEDs or other LEDs depending on the desired application.

The speaker assembly 26 may form a sealed closure for the cavity opening 80 at the second end 36 of the handle housing 14, while also forming a housing for a speaker 140. In one embodiment, referring to FIG. 2, the speaker assembly 26 includes a trim ring 142, a sealing ring 144, a speaker seal 146, speaker 140, and a tail housing 148. As shown, the trim ring 142 includes a molded plastic ring 142 having a handle end 150 and a tail end 152. The handle end 150 includes an annular channel 154 extending around the ring 142 to form a receptacle for the sealing ring 144. The handle end 150 may also include a pair of tabs 156 extending outwardly from the handle end 150 for connection to the inner housing 22 as described in more detail below. The tail end 152 of the trim ring 142 may define an annular recess 158 that receives a speaker seal ring 146. The tail housing 148 is also ring shaped, and includes a rim portion 164 that can receive the speaker 140 within the rim portion 164 and extend into the annular channel 158 of the trim ring 142 to capture the speaker 140 between the trim ring 142 and the tail housing 148. The rim portion 164 may be attached to the trim ring 142 by ultrasonic welding within the annular channel 158. The speaker 140 may be connected to the printed circuit board 24, for example with a pair of electrical leads (not shown), such that the speaker 140 is connected to the microcontroller and can be actuated as a function of the programming of the microcontroller and in correspondence with the LEDs 20. The tail end 160 of the tail housing 148 may be frustoconical, forming an amplifier for the speaker 140.

The inner housing 22 may be a two-piece housing 22 capable of clamping together about the printed circuit board 24 and its components. As shown in FIG. 2, the inner housing 22 includes an upper member 170 and a lower member 172, which may be molded plastic members and may be formed from a transparent, translucent, or other light transmissive plastic. The upper 170 and lower 172 members clamp together to form a generally cylindrical housing 22 via a series of six snap tabs 174 extending from the lower member 172 extending into receptacles 176 in the upper member 170. The inner housing 22 includes a first longitudinal end 178 proximate the first end 34 of the handle housing 14, and a second longitudinal end 180 proximate the second end 36 upon insertion of the inner housing 22 into the interior cavity 40 of the handle housing 14. The upper 170 and lower 172 members snap together about the printed circuit board 24. In one embodiment, the second longitudinal end 180 includes an inner surface 182 having opposed inwardly extending ribs 184 that can interfit with the tabs 156 at the handle end 150 of the trim ring 142 to hold and retain the trim ring 142. A set screw 186 may extend through the handle housing 14 and into the trim ring 142 to attach the inner housing 22 and speaker assembly 26, and all of the electrical components, to the handle housing 14.

In one embodiment, the inner housing 22 includes one or more flexible portions to enable actuation of the switches from the exterior of the inner housing 22. As shown, the inner housing member 170 includes three such flex portions, including a power switch flex portion 188, and first and second operation flex portions 198, 199. Referring to FIG. 2, each of these flexible portions is formed by a cutout 201 extending around substantially all of a paddle portion 203, except for a flexible neck 205 connecting the paddle 203 to the remainder of the housing member 170.

Figure 15:
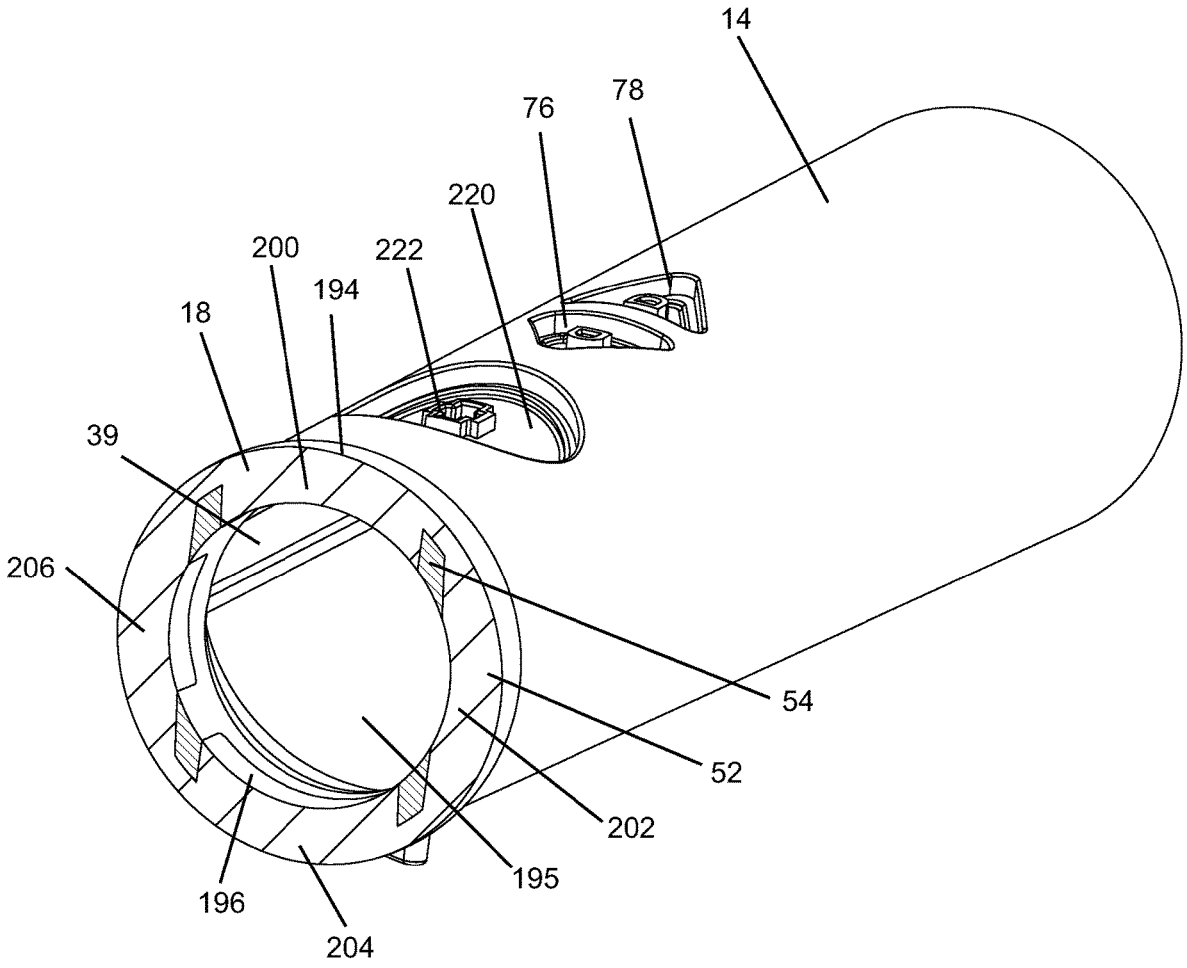
FIG. 15 is a sectional view of the portions of the lighted toothbrush handle taken along line XV-XV in FIG. 14.

Referring to FIGS. 2 and 15, the light ring 18 is a ring made of translucent, transparent, or otherwise light transmissive material that is attached to the handle housing 14 over the circumferential light ring opening 52. In one embodiment, the light ring 18 is overmolded onto the handle housing 14. The light ring 18 includes an upper end 190, a lower end 192, an external surface 194, and an internal surface 196, with the internal and external surfaces forming a ring thickness therebetween, and the internal surface 196 forming the outer boundary of an internal light space 195. As shown in FIG. 15, the light ring 18 is attached over the circumferential opening 52 with the struts 54 projecting into the light ring 18 through a substantial portion of the ring thickness, to effectively separate the light ring 18 into four sections 200, 202, 204 and 206. As described in more detail below, when the inner housing 22 is inserted into the interior cavity 40 of the handle housing 14, the first end 90 of the printed circuit board 24 extends through the light ring 18 such that the indicator LEDs are positioned within the internal light space 195 of the light ring 18.

Figure 14:
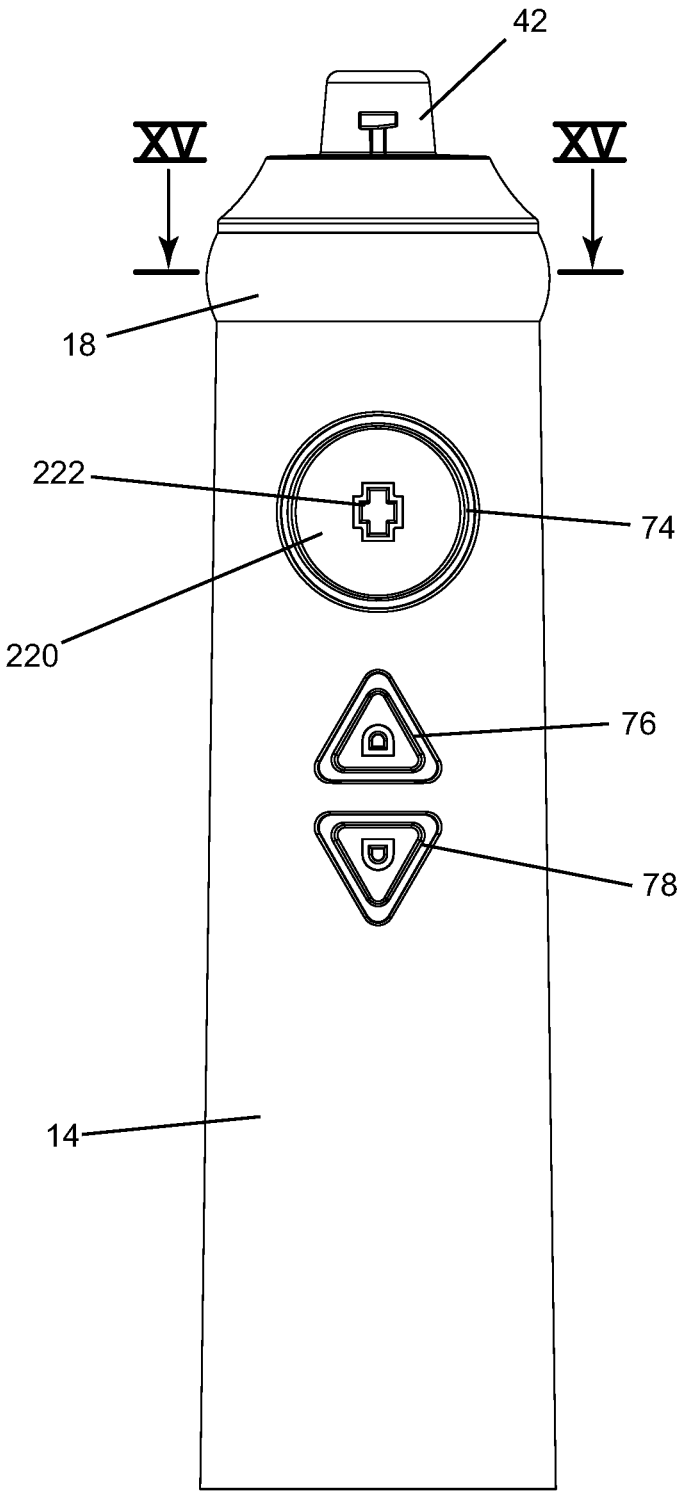
FIG. 14 is a front view of portions of the lighted toothbrush handle according to one embodiment.

Referring to FIGS. 14 and 15, a sealing member 220 may be positioned within the handle housing 14 on the interior surface 39 of the handle housing sidewall 32, covering the power button opening 74, and the operation openings 76, 78. In one embodiment, the sealing member 220 is a single piece formed from a flexible material, such as a thermoplastic elastomer. The elastomer can be adhered to the inner surface 39 to create a watertight seal at the openings 74, 76 and 78, or may otherwise be pressed tightly between the handle housing 14 and the inner housing 22 to form the watertight seal. In another embodiment, multiple elastomeric members may be used, such as a separate elastic member for each of the openings 74, 76, 78. As shown in FIG. 15, the sealing member 220 may include a protrusion 222 extending from the surface of the sealing member 220 within each of the openings. The sealing member 220 may be made from a transparent, translucent, or other light transmissive material to enable light from an LED, such as the power button LED 136, to transmit through the sealing member 220 and the power button opening 74 and be visible to a user on the exterior of the toothbrush handle 12. Referring now to FIGS. 2 and 15, the sealing member 220 may extend under the operation openings 76, 78 to provide a watertight seal for the openings 76, 78.

As shown in FIG. 2, the power button opening 74 and the operation openings 76, 78 may be covered by individual buttons, including a power button 230, a first operation button 232, and a second operation button 234. Each button may be sized and shaped to match the shape of the corresponding opening. For example, in the illustrated embodiment, the power button 230 is circular, and the operation buttons 232, 234 are triangular (and facing in opposite directions). In the illustrated embodiment, the power button 230 has a top surface 240 that is generally convex, and includes a perimeter edge 242 with a series of facets 244 extending around the power button 230 adjacent to the perimeter edge 242. The facets 244 may act to refract light from the power button LED 136 as it is transmitted through the inner housing 22, sealing member 220 and the power button 230.

Assembly of the toothbrush handle 12 generally includes providing the handle housing 14, and overmolding the light ring 18 onto the handle housing 14 such that the light transmissive light ring 18 surrounds and fills the circumferential opening 52. The light ring may be formed around the four struts 54 with the struts extending through a substantial portion of the light ring thickness such that each of the four circumferential light ring openings 58, 60, 62 and 64 is separated by the struts 54 and visible through the light ring 18. The light transmissive, elastomeric sealing member 220 may be inserted into, or molded into, the interior cavity 40 of the handle housing 14 to cover and seal the power button opening 74 and the operation openings 76, 78. The power button 230 and operation buttons 232, 234 may be attached to the sealing member 220, for example, with an adhesive between each button 230, 232, 234 and its corresponding protrusion 222 on the sealing member 220.

The components within the internal cavity 40 may be assembled and inserted in a variety of sequences and methods. In one embodiment, the components are mounted to the printed circuit board 24, the inner housing 22 is closed about the circuit board 24, and the completed assembly is inserted into the handle housing 14 via the cavity opening 80.

The printed circuit board 24 is provided, and the various components are mounted to the printed circuit board 24 by conventional methods. The microcontroller 98, motor 30, battery contacts 25, power switch 102, operation switches 106, 108, indicator LEDs 20 and power switch LED 136 are each mounted to the printed circuit board 24 at predetermined locations, such as those noted. The upper and lower members 170, 172 of the inner housing 22 are snapped together with the six snap tabs 174 extending from the lower member 172 and extending into the snap receptacles 176 on the upper member 170. Notably, the printed circuit board 24 is oriented within the inner housing 22 with the right side edge 88 facing the upper housing member 170 and the left side edge 86 facing the lower housing member 172, and with the power switch 102 and operation switches 106, 108 positioned such that their projections 104, 110, 112 are aligned under and adjacent to the paddle portions 203 of their corresponding flex portions 188, 198, 199 on the inner housing 22 such that flexing by pressing down each paddle portion 203 will depress the projection 104, 110, or 112 of the associated switch.

Assembly of the speaker assembly 26 includes positioning the speaker 140 within the rim portion 164 of the tail housing 148, and positioning the speaker seal ring 146 in the annular channel 158 of the trim ring 142 (or on top of the speaker 140 within the tail housing 148). The rim portion 164 of the tail housing 148 is inserted into the annular channel 158 of the trim ring 142, and the rim portion 164 is attached within the channel 158 by a conventional method, such as an ultrasonic weld. The assembled speaker assembly 26 is attached to at least one of the inner housing 22 or the handle housing 14. In the illustrated embodiment, it is attached to both, wherein the trim ring 142 is captured by the inner housing 22 when the inner housing 22 members 170, 172 are snapped together, and the trim ring 142 and inner housing 22 are attached to the handle housing 14 via the set screw 186.

Insertion of the assembled inner housing 22 into the handle housing 14 includes aligning the inner housing 22 and printed circuit board 24 rotationally and longitudinally with respect to the handle housing 14. As shown in FIG. 2, the assembled inner housing 22 is inserted through the cavity opening 80 and into the interior cavity 40 along the longitudinal axis 35. The inner housing 22 is longitudinally inserted such that the longitudinal position of the indicator LEDs 20 is within the interior light space 195 of the light ring 18. The inner housing 22 is rotationally oriented such that the power switch flex portion 188, first operation switch flex portion 198, and second operation switch flex portion 199, are aligned underneath the power button 230, first operation button 232, and the second operation button 234.

In addition, the inner housing 22 and printed circuit board 24 are oriented within the handle housing 14 such that the indicator LEDs 20 are each directed through a uniquely associated one of the four circumferential light ring openings 58, 60, 62 and 64. More particularly, the first indicator LED 120 is directed through the light ring opening 58, the second indicator LED 122 is directed through the light ring opening 60, the third indicator LED 124 is directed through the light ring opening 62, and the fourth indicator LED 126 is directed through the light ring opening 64. With the separation between light ring openings created by the struts 54, each of the indicator LEDs is independently and separately visible (when lit) through its associated light ring opening 58, 60, 60 or 64. The positioning of the LEDs on the printed circuit board 24, and with respect to the light ring 18, results in the four indicator LEDs each directing light at about a 90 degree angle with respect to the adjacent indicator LEDs. The interior cavity 40 and the inner housing 22 may include complimentary structure to properly rotationally align the inner housing 22, and the insertion of the set screw 186 also sets alignment. Batteries 28 may be inserted by removing the set screw 186, sliding the inner housing 22 out of the interior cavity 40, inserting the batteries 28 between the battery contacts 25, and reinserting the inner housing 22 as noted above.

Operation of the handle 12 is a function of the programming of the microcontroller 98. In one embodiment, the microcontroller 98 is programmed to activate the motor 30, the speaker 140, the power button LED 136, and the indicator LEDs 20 selectively upon pressing of the power button 230 to activate the power switch 102. For example, upon pressing the power button 230 and activating the power switch 102, the microcontroller 98 may be programmed to activate the motor 30 for a predetermined period of time. In one embodiment, the motor 30 will run for 2 minutes upon activation of the power switch 102. The motor 30 may be programmed to pulse or turn off and on at predetermined intervals, such as every 30 seconds, to signal a user to switch quadrants of the teeth while brushing. Other motor operations, such as slower or faster speeds, may also be programmed, and may be selectable, for example, by pressing one of the operation buttons 232, 234. The microcontroller 98 may also be programmed to activate the speaker 140, and may be provided with one or more messages, songs, or game instructions, that are selectively played upon pressing the power button 230. Similar to the motor 30 operation, the operation and output of the speaker 140 may be changed, for example, by pressing one of the operation buttons 232, 234.

Figure 9:
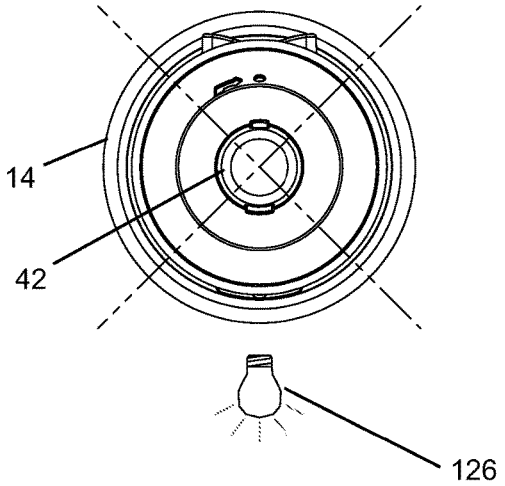
FIG. 9 is a top view of the lighted toothbrush handle indicating the activation of an LED.
Figure 10:
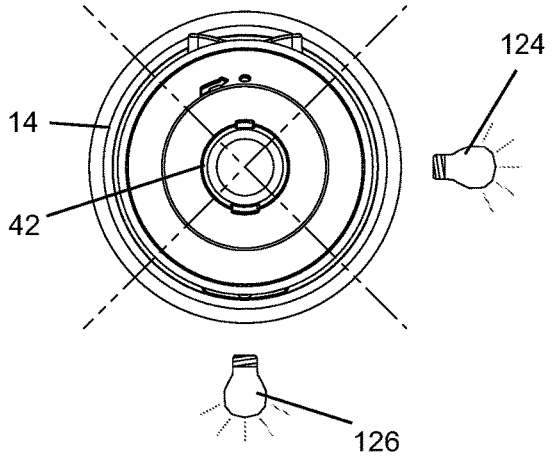
FIG. 10 is a top view of the lighted toothbrush handle indicating the activation of two LEDs.
Figure 11:
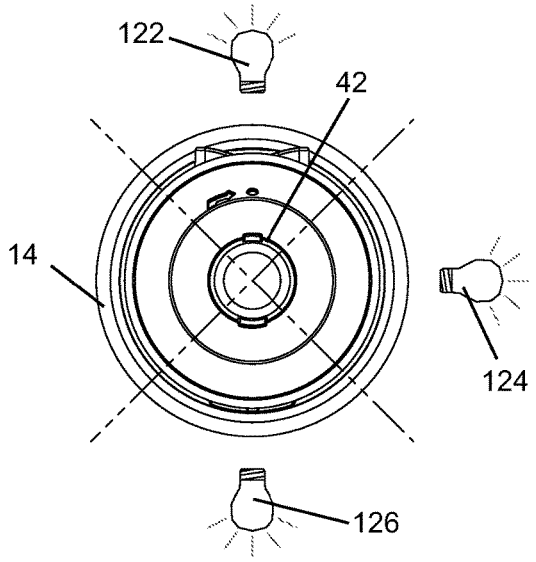
FIG. 11 is a is a top view of the lighted toothbrush handle indicating the activation of three LEDs.
Figure 12:
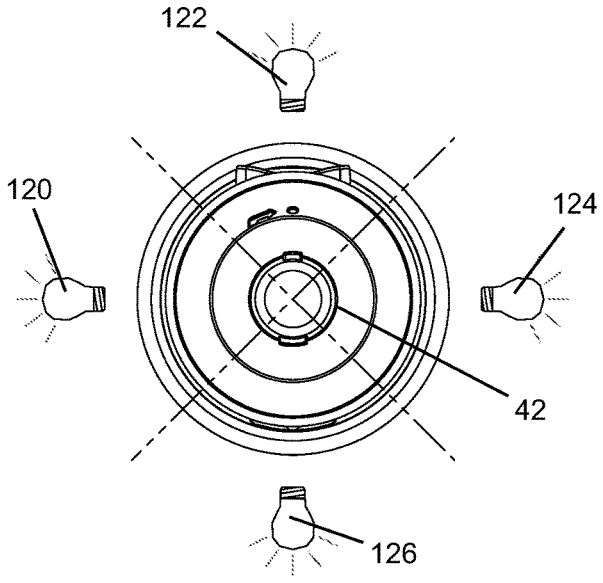
FIG. 12 is a top view of the lighted toothbrush handle indicating the activation of four LEDs.

The plurality of LEDs may also be lit or unlit as a function of the programming of the microcontroller 98. In one example, the indicator LEDs are programmed to light in a predetermined sequence. Upon depressing the power switch 102, the microcontroller 98 operates the indicator LEDs to light the fourth indicator LED 126 for a first 30-second time interval, as shown in FIG. 9, and then also light the third indicator LED 124 for a second 30-second time interval as shown in FIG. 10, and then also light the second indicator LED 122 for a third 30-second time interval as shown in FIG. 11, and then also light the first indicator LED 120 for a fourth 30-second time interval as shown in FIG. 12. As noted above, these time intervals may coincide with operations of the speaker 140 and motor 30, such that the speaker may change output upon each of the time intervals, to indicate that is it time to move the toothbrush to a new quadrant, or to indicate that it is time to stop brushing at the end of the two minute period. Similarly, the motor 30 may change functions at each interval. In one embodiment, at the end of the full two minute time period (the completion of four 30-second time intervals), the microcontroller may cause the indicator LEDs to turn on and off sequentially, to appear that the lights are "moving" around the led ring 18.

In one embodiment, the power button LED 136 also operates as a function of the microcontroller 98, and the power switch 102 or the operation switches 106, 108. In one example, the power button LED 136 is programmed to turn on upon a user pressing the power button 230 (which, mechanically, flexes the sealing member 220 and the flex portion 188 to depress the projection 104 and actuate the power switch 102 such that the power button LED is visible through the faceted power button 230). The power button LED may be on, or may flash on and off, for a predetermined time period, which may be the same as the 30-second intervals noted above. In another embodiment, the power button LED 136 may change color to indicate a particular theme or mode. For instance, upon pressing the power button 230 a first time, the power button LED 136 may light up in a first color, and upon pressing the power button a second time, the power button LED 136 may light up in a second color. In another embodiment, pressing either of the operation buttons 232, 234 may cause the color of the power button LED 136 to change. The change in color may signal a change in the theme or a change in the "game" that is provided by the combination of the indicator LEDs 20, speaker 140 and motor 30. For example, a first color of the power button LED 136 may indicate a first operation of the indicator LEDs, speaker 140 and motor 30, and a second color of the power button LED 136 may indicate a different operation of the indicator LEDs 20, speaker 140 and motor 30, such as different LED sequences, different time intervals, different sounds or coaching from the speaker 140, and different motor 30 operation such as "bursts" of motor 30 speed to indicate an aspect of game play. Other colors of the LED 136 may indicate still other operations, which may be changed by additional presses of the power button 230, or pressing the operation buttons 232, 234. In one embodiment, the microcontroller 98 may be programmed to "unlock" certain operations and sequences only after the microcontroller 98 has registered a predetermined number of brushing periods.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A lighted handle for a toothbrush, comprising:

a handle housing having a first end and a second end, the first end including an attachment structure for selective attachment to a toothbrush head, the second end opposite the first end, the handle housing defining an interior cavity, the handle housing defining a longitudinal length between the first and second ends extending along a longitudinal axis;

a power source positioned within the interior cavity;

a printed circuit board mounted within the interior cavity, the printed circuit board having a first surface, a second surface facing opposite the first surface, a left side edge, a right side edge, and opposing longitudinal ends defining a longitudinal length therebetween;

a plurality of indicator LEDs mounted to the printed circuit board at generally the same position along the longitudinal length of the printed circuit board, a first one of the indicator LEDs mounted to the first surface of the printed circuit board, and a second one of the indicator LEDs mounted to the second surface of the printed circuit board;

a power switch on the printed circuit board in electrical communication with the power source and with the plurality of indicator LEDs, wherein the power switch can be pressed by a user to activate one or more of the plurality of indicator LEDs; and a light ring formed of a light transmissive material and positioned on the handle housing circumferentially surrounding the longitudinal axis and adjacent the first and second ones of the plurality of LEDs, wherein light from the first LED is visible through the light ring at a first circumferential position on the handle housing and light from the second LED is visible through the light ring at a second circumferential position on the handle housing.

2. The lighted handle of claim 1 including a power LED that is mounted to the printed circuit board and spaced from the indicator LEDs along the longitudinal length of the printed circuit board.

3. The lighted handle of claim 2 wherein the light ring includes an exterior circumference and an interior circumference, the interior circumference facing towards the longitudinal axis and defining an interior light space, wherein a portion of the printed circuit board including the first and second indicator LEDs is positioned in the interior light space.

4. The lighted handle of claim 3 wherein the plurality of indicator LEDs includes a third indicator LED mounted to the first surface of the printed circuit board and directing light outwardly from the left side edge of the circuit board, and a fourth indicator LED mounted to the second surface of the printed circuit board and directing light outwardly from the right side edge of the circuit board, wherein light from the first, second, third and fourth indicator LEDs are independently visible through the light ring.

5. The lighted handle of claim 4 wherein the third indicator LED is positioned adjacent to the left side edge and is spaced from the first indicator LED, and the fourth indicator LED is positioned adjacent to the right side edge and spaced from the second indicator LED.

6. The lighted handle of claim 5 wherein the first indicator LED is evenly spaced between the left and right side edges on the first surface of the printed circuit board, and the second indicator LED is evenly spaced between the left and right side edges on the second surface of the printed circuit board.

7. The lighted handle of claim 6 wherein the handle housing defines at least one indicator opening, the light ring mounted with in the indicator opening to cover the indicator opening.

8. The lighted handle of claim 7 wherein the handle housing defines four circumferential indicator openings, the printed circuit board positioned within the interior light space of the light ring with each one of the indicator LEDs positioned behind an associated one of the circumferential indicator openings.

9. The lighted handle of claim 8 wherein the power switch is mounted on one of the first and second surfaces of the printed circuit board, the power switch including a projection that can be depressed by a user to activate the power switch, the projection extending beyond one of the left and right side edges of the printed circuit board.

10. The lighted handle of claim 9 wherein the power LED is mounted adjacent to the projection.

11. A lighted handle for a toothbrush comprising:

A tubular handle housing having a first end and a second end and defining a longitudinal axis extending through the tubular handle housing and through the first and second ends, the first end including an attachment structure for selective attachment to a toothbrush head, the second end opposite the first end, the handle housing defining an interior cavity;

a power source positioned within the interior cavity;

a printed circuit board mounted within the interior cavity, the printed circuit board having a first surface, a second surface facing opposite the first surface, a left side edge, and a right side edge;

a plurality of LEDs mounted to the printed circuit board;

a power switch on the printed circuit board in electrical communication with the power source and with the plurality of LEDs, wherein the power switch includes a protrusion that can be depressed by a user to activate one or more of the plurality of LEDs, wherein one of the LEDs is a button LED that is positioned on the circuit board adjacent to the power switch, and wherein at least two of the LEDs are indicator LEDs that are spaced from the button LED, a first one of the indicator LEDs mounted on the first surface of the printed circuit board adjacent to the left side edge, a second one of the indicator LEDs positioned on the second surface of the printed circuit board adjacent to the right side edge;

a light ring connected to the handle housing and formed from a light transmissive material, the light ring extending circumferentially about the longitudinal axis and positioned between the first and second ends of the housing such that it is adjacent to the indicator LEDs, the light from each of the indicator LEDs visible from the exterior of the handle housing through the light ring; and a button opening defined in the handle housing adjacent to the power switch, wherein light from the button LED is visible from the exterior of the handle through the button opening.

12. The lighted handle of claim 11 including a faceted button plate positioned within the button opening, the light from the button LED being visible through the button plate, and wherein the button plate is positioned above the power switch protrusion, such that depression of the button plate depresses the power switch to activate one or more of the LEDs.

13. The lighted handle of claim 12, wherein the first one of the indicator LEDs is directed away from the left side edge of the printed circuit board, and wherein the second one of the indicator LEDs is directed away from the right side edge of the printed circuit board.

14. The lighted handle of claim 13 including a microcontroller mounted on the printed circuit board in electrical communication with the LEDs, wherein the microcontroller is programmed to selectively light the button LED, and to light the indicator LEDs in a predetermined sequence upon activation of the power switch.

15. The lighted handle of claim 14, wherein the light ring includes an annular sidewall, the sidewall having an interior surface and an exterior surface, the interior surface forming an interior light space.

16. The lighted handle of claim 15, wherein a portion of the printed circuit board including the plurality of LEDs is positioned in the interior light space.

17. The lighted handle of claim 16, wherein the plurality of LEDs includes four of the indicator LEDs, with a third indicator LED mounted to the first surface of the printed circuit board and spaced from the first indicator LED, and a fourth indicator LED mounted to the second surface of the printed circuit board and spaced from the second indicator LED, wherein light from the first, second, third and fourth indicator LEDs are independently visible from the exterior of the light ring.

18. A lighted handle for a toothbrush comprising:

a handle housing having a first end and a second end, the first end including an attachment structure for selective attachment to a toothbrush head, the second end opposite the first end, the handle housing defining an interior cavity;

a power source positioned within the interior cavity;

a printed circuit board mounted within the interior cavity, the printed circuit board having a first surface, a second surface facing opposite the first surface, a left side edge, a right side edge, and opposing longitudinal ends, the printed circuit board defining a longitudinal length defined between the longitudinal ends;

a plurality of LEDs mounted to the printed circuit board, including a plurality of indicator LEDs mounted at approximately the same position along the longitudinal length, a first one of the indicator LEDs mounted to the first surface of the printed circuit board, a second one of the indicator LEDs mounted to the second surface of the printed circuit board, a third one of the indicator LEDs mounted to the first surface of the printed circuit board adjacent to the left side edge and spaced from the first indicator LED, a fourth indicator LED mounted to the second surface of the printed circuit board adjacent to the right side edge and spaced from the second indicator LED;

a power switch on the printed circuit board in electrical communication with the power source and with the plurality of LEDs, wherein the power switch can be pressed by a user to activate one or more of the plurality of LEDs;

a microcontroller mounted on the printed circuit board and in connection with the LEDs, the microcontroller programmed to sequentially activate the indicator LEDs upon activation of the power switch; and a light ring mounted to the handle housing and extending around a circumference of the handle housing and extending circumferentially around the printed circuit board such that the printed circuit board extends through the light ring, wherein light from the first, second, third and fourth indicators LEDs are independently visible through the light ring.

19. The lighted handle of claim 18, wherein the plurality of LEDs includes a button LED mounted to the printed circuit board adjacent to the power switch, the microcontroller programmed to activate the button LED as a function of the power switch.

20. The lighted handle of claim 19 including a button opening defined in the handle housing adjacent to the power switch, wherein light from the button LED is visible from the exterior of the handle housing through the button opening.

* * * * *